US012290096B2

(12) United States Patent
Prestia

(10) Patent No.: US 12,290,096 B2
(45) Date of Patent: May 6, 2025

(54) AEROSOL GENERATING SUBSTRATE ELEMENT WITH DUAL PAPER WRAPPERS

(71) Applicant: PHILIP MORRIS PRODUCTS S.A., Neuchâtel (CH)

(72) Inventor: Ivan Prestia, Calderara di Reno (IT)

(73) Assignee: Philip Morris Products S.A., Neuchâtel (CH)

( * ) Notice: Subject to any disclaimer, the term of this patent is extended or adjusted under 35 U.S.C. 154(b) by 365 days.

(21) Appl. No.: 17/779,330

(22) PCT Filed: Nov. 23, 2020

(86) PCT No.: PCT/IB2020/061051
§ 371 (c)(1),
(2) Date: May 24, 2022

(87) PCT Pub. No.: WO2021/105856
PCT Pub. Date: Jun. 3, 2021

(65) Prior Publication Data
US 2022/0408800 A1 Dec. 29, 2022

(30) Foreign Application Priority Data
Nov. 29, 2019 (EP) ..... 19212680

(51) Int. Cl.
*A24F 40/46* (2020.01)
*A24B 15/12* (2006.01)
(Continued)

(52) U.S. Cl.
CPC ..... *A24D 1/02* (2013.01); *A24B 15/12* (2013.01); *A24D 1/20* (2020.01); *A24F 40/20* (2020.01);
(Continued)

(58) Field of Classification Search
CPC .. A24D 1/02; A24D 1/20; A24B 15/12; A24B 15/14; A24F 40/20; A24F 40/46;
(Continued)

(56) References Cited

U.S. PATENT DOCUMENTS 4,341,228 A 7/1982 Keritsis et al.
4,574,821 A 3/1986 Fischer et al.
(Continued)

FOREIGN PATENT DOCUMENTS

CH 691156 5/2001
EP 0 419 974 A2 4/1991
(Continued)

OTHER PUBLICATIONS

Second Office Action for CN Application No. 202080078688.9 issued by the Chinese Patent Office on Aug. 23, 2023; 13 pgs. Including English translation.
(Continued)

*Primary Examiner* — Truc T Nguyen
(74) *Attorney, Agent, or Firm* — Mueting Raasch Group

(57) ABSTRACT

An aerosol generating substrate element is circumscribed by exactly two paper layers that do not extend beyond an aerosol generating substrate. The aerosol generating substrate includes from about 10% to about 30% glycerine by weight. The first paper wrapper and the second paper wrapper have a combined thickness in a range from about 60 micrometres to about 200 micrometres. The first paper wrapper does not overlap itself and a second paper wrapper does not overlap itself.

20 Claims, 1 Drawing Sheet

(51) Int. Cl.

| | |
|---|---|
| ***A24D 1/02*** | (2006.01) |
| ***A24D 1/20*** | (2020.01) |
| ***A24F 40/20*** | (2020.01) |
| ***A24F 40/465*** | (2020.01) |
| ***D21H 27/30*** | (2006.01) |

(52) U.S. Cl.
CPC ..... *A24F 40/46* (2020.01); *A24F 40/465* (2020.01); *D21H 27/30* (2013.01)

(58) Field of Classification Search
CPC ..... A24F 40/465; D21H 27/30; D21H 27/00; D21H 5/16; H05B 3/42; H05B 6/105
See application file for complete search history.

(56) References Cited

U.S. PATENT DOCUMENTS

| | | | | | |
|---|---|---|---|---|---|
| 5,131,416 | A | | 7/1992 | Gentry | |
| 5,584,306 | A | | 12/1996 | Beauman et al. | |
| 5,588,446 | A | * | 12/1996 | Clearman | A24B 15/165 131/194 |
| 5,692,525 | A | * | 12/1997 | Counts | A24D 3/17 131/194 |
| 5,724,998 | A | | 3/1998 | Gellatly et al. | |
| 6,216,706 | B1 | | 4/2001 | Kumar et al. | |
| 2002/0185143 | A1 | * | 12/2002 | Crooks | A24D 1/02 131/365 |
| 2006/0090769 | A1 | * | 5/2006 | Woodson | A24D 1/00 131/335 |
| 2010/0108081 | A1 | * | 5/2010 | Blevins Joyce | A24D 1/025 131/274 |
| 2012/0017925 | A1 | * | 1/2012 | Sebastian | A24D 1/02 131/345 |
| 2013/0199550 | A1 | * | 8/2013 | Ono | A24D 1/02 131/331 |
| 2013/0306087 | A1 | * | 11/2013 | Rose | A24D 1/025 131/365 |
| 2015/0157052 | A1 | * | 6/2015 | Ademe | A24D 1/22 131/58 |
| 2015/0201670 | A1 | * | 7/2015 | Crooks | A24C 5/47 131/88 |
| 2017/0055576 | A1 | * | 3/2017 | Beeson | A24D 1/02 |
| 2020/0281249 | A1 | * | 9/2020 | Sebastian | A24B 15/167 |

FOREIGN PATENT DOCUMENTS

| | | | | |
|---|---|---|---|---|
| EP | 0822670 | | 3/1999 | |
| EP | 2667737 | | 12/2013 | |
| EP | 2797450 | | 11/2017 | |
| WO | 2010043475 | | 4/2010 | |
| WO | 20120164009 | | 12/2012 | |
| WO | 20150107975 | | 7/2015 | |
| WO | 2017036586 | | 3/2017 | |
| WO | WO 2019030363 | * | 2/2019 | A24F 47/00 |

OTHER PUBLICATIONS

European Search Report for EP 19212680.3 issued by the European Patent Office on Feb. 20, 2020; 7 pgs.
International Search Report and Written Opinion for PCT/IB2020/061051 issued by the European Patent Office on Dec. 23, 2020; 13 pgs.
International Preliminary Report on Patentability for PCT/IB2020/061051 issued by the European Patent Office on Feb. 8, 2022; 14 pgs.

* cited by examiner

AEROSOL GENERATING SUBSTRATE ELEMENT WITH DUAL PAPER WRAPPERS

This application is the § 371 U.S. National Stage of International Application No. PCT/IB2020/061051, filed 23 Nov. 2020, which claims the benefit of European Application No. 19212680.3, filed 29 Nov. 2019, the disclosures of which are incorporated herein by reference.

The present disclosure relates to dual paper wrappers used in an aerosol generating substrate element. An aerosol generating substrate is circumscribed by exactly two paper wrapper layers to form the aerosol generating substrate element.

Aerosol generating articles in which an aerosol generating substrate, such as a tobacco containing substrate, is heated rather than combusted, are known in the art. Typically in such heated aerosol generating articles, an aerosol is generated by the transfer of heat from a heat source to a physically separate aerosol generating substrate or material, which may be located in contact with, within, around, or downstream of the heat source. During use of the aerosol generating article, volatile compounds are released from the aerosol generating substrate by heat transfer from the heat source and are entrained in air drawn through the aerosol generating article. As the released compounds cool, they condense to form an aerosol.

Paper that is used to wrap the aerosol generating substrate and form the aerosol generating element can absorb aerosol former, water and other liquid compounds found in the mainstream smoke or aerosol passing through the aerosol generating article, or humidity or moisture surrounding the paper. The absorbed liquid may stain or weaken the paper and negatively affects the appearance and structural integrity of the aerosol generating article. Heated aerosol generating articles are particularly susceptible to wetting and breakage due to the high levels of aerosol former in the aerosol generating substrate of these heated aerosol generating articles. Heated aerosol generating articles are particularly susceptible to swelling as aerosol components are absorbed by the wrapper, leading to difficult removal from the heating device.

A resistive heating blade may be inserted into the aerosol generating substrate to heat the aerosol generating substrate and release volatile compounds from the aerosol generating substrate. The resistive heating blade may provide a localized heat source within the aerosol generating substrate that may be located along a central axis of the aerosol generating substrate. The aerosol generating substrate located about the periphery or interface with the paper wrapper may not be sufficiently heated by the centrally located resistive heating blade, resulting in unused aerosol generating substrate within the aerosol generating element.

It would be desirable to provide a visually and mechanically stable aerosol generating substrate element, particularly for heat-not-burn aerosol generating substrates that contain a high level of liquids or aerosol formers. It would also be desirable that this thick paper layer does not affect the taste of the aerosol generated by the aerosol generating substrate element.

It would be desirable to provide an aerosol generating substrate element that reduces the amount of unused aerosol generating substrate within the aerosol generating element.

It would be desirable that this wrapper not readily burn if proximate a heating element and not negatively affect the heating of the heat-not-burn aerosol generating substrate.

A purpose of the invention may be to solve at least partially one or more of the desirable technical benefits mentioned above.

According to this disclosure, there is provided an aerosol generating substrate element comprising a cylindrical aerosol generating substrate and a first paper wrapper and a second paper wrapper circumscribing the aerosol forming substrate. The first paper wrapper and the second paper wrapper have a combined thickness in a range from about 60 micrometres to about 200 micrometres. The first paper wrapper and the second paper wrapper do not extend beyond the aerosol generating substrate. The first paper wrapper does not overlap itself and a second paper wrapper does not overlap itself.

Preferably, an aerosol generating substrate element comprising a cylindrical aerosol generating substrate and a first paper wrapper and a second paper wrapper circumscribing the aerosol forming substrate. The cylindrical aerosol generating substrate includes from about 10% to about 30% glycerine by weight. The first paper wrapper and the second paper wrapper have a combined thickness in a range from about 60 micrometres to about 200 micrometres. The first paper wrapper and the second paper wrapper do not extend beyond the aerosol generating substrate. The first paper wrapper does not overlap itself and a second paper wrapper does not overlap itself.

According to this disclosure, there is provided an aerosol generating substrate element comprising a cylindrical aerosol generating substrate, a first paper wrapper, and a second paper wrapper circumscribing the first paper wrapper. The first paper wrapper comprises opposing edges that abut each other to circumscribe the aerosol forming substrate and form a first seam line. The second paper wrapper comprises opposing edges that abut each other to circumscribe the first paper wrapper and form a second seam line. The first seam line is offset from the second seam line. The first paper wrapper and the second paper wrapper do not extend beyond the aerosol generating substrate.

Preferably the first seam line is offset from the second seam line by at least about 5%, or at least about 10%, or at least about 15% of a circumference of the aerosol generating substrate.

Preferably, the aerosol generating substrate is circumscribed by less than three paper layers at any point around a circumference of the aerosol generating substrate that do not extend beyond the aerosol generating substrate.

The first paper wrapper and the second paper wrapper may have a combined thickness in a range from about 78 micrometers to about 160 micrometers. The first paper wrapper and the second paper wrapper may have a combined thickness in a range from about 78 micrometers to about 140 micrometers. The first paper wrapper and the second paper wrapper may have a combined thickness in a range from about 90 micrometers to about 140 micrometers. The first paper wrapper and the second paper wrapper may have a combined thickness in a range from about 100 micrometers to about 140 micrometers. The first paper wrapper and the second paper wrapper may have a combined thickness in a range from about 110 micrometers to about 140 micrometers. The first paper wrapper and the second paper wrapper may have a combined thickness in a range from about 125 micrometers to about 140 micrometers. The first paper wrapper and the second paper wrapper may have a combined thickness in a range from about 130 micrometers to about 140 micrometers.

The first paper wrapper and the second paper wrapper may have a uniform combined thickness that does not differ at any point around a circumference of the aerosol generating substrate element by more than about 30 micrometres, or more than about 20 micrometres, or more than about 10 micrometres, or more than about 5 micrometres.

The aerosol generating substrate may define a substantially cylindrical shape having a diameter in a range from about 6.8 mm to about 7.1 mm, or from about 6.8 mm to about 7.0 mm.

The first paper wrapper and the second paper wrapper may have a combined thickness to tobacco substrate diameter ratio in a range from about 1:120 to about 1:40. The first paper wrapper and the second paper wrapper may have a combined thickness to tobacco substrate diameter ratio in a range from about 1:100 to about 1:50. The first paper wrapper and the second paper wrapper may have a combined thickness to tobacco substrate diameter ratio in a range from about 1:70 to about 1:50. The first paper wrapper and the second paper wrapper may have a combined thickness to tobacco substrate diameter ratio in a range from about 1:60 to about 1:50.

The aerosol generating substrate may include homogenized tobacco material. The homogenized tobacco material may include tobacco material, from about 1 percent to about 5 percent of a binder, and from about 5 percent to about 30 percent of an aerosol-former, in dry weight basis. The aerosol generating substrate may include a gathered sheet of homogenized tobacco material that is preferably crimped.

Preferably, the aerosol generating substrate may include homogenized tobacco material. The homogenized tobacco material may include tobacco material, from about 1 percent to about 5 percent of a binder, and from about 10 percent to about 30 percent glygerine, in dry weight basis. The aerosol generating substrate may include a gathered sheet of homogenized tobacco material that is preferably crimped.

The aerosol generating substrate may include a metallic induction heating element. The aerosol generating substrate may include a plurality of metallic induction heating elements.

According to this disclosure, there is provided an aerosol generating system comprising, the aerosol generating article, described herein, and an aerosol generating device comprising a heating element configured to heat the aerosol generating substrate.

The heating element may be a resistive heating blade element configured to be inserted into the aerosol generating substrate. The heating element may be an inductive heating element configured to inductively heat metallic induction heating elements embedded within the aerosol generating substrate.

Advantageously, aerosol generating substrate elements that include a thick dual wrapper may provide a visually and mechanically stable aerosol generating substrate element, particularly for heat-not-burn aerosol generating substrates that contain a high level of liquids or aerosol formers. As a result, swelling, visible staining and physical weakening of the wrapper portion of the aerosol generating article may be reduced even when a high level of humectant is included in the aerosol generating substrate.

Advantageously, aerosol generating substrate elements that include a thick dual wrapper may be formed on conventional substrate element forming manufacturing equipment. This may improve the processability of the aerosol generating substrate elements and reduce manufacturing costs.

Advantageously, aerosol generating substrate elements that include a thick dual wrapper may increase the amount of aerosol generating substrate that is uniformly heated and consumed, thus reducing unused or wasted aerosol generating substrate material.

Advantageously, aerosol generating substrate elements that include a thick dual wrapper may utilize internal heating of the aerosol generating substrate via induction or resistive heating elements embedded or inserted into the aerosol generating substrate, and the thick dual wrapper wrapping the aerosol generating substrate may not negatively affect the heating of the heat-not-burn aerosol generating substrate.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming substrate. For example, aerosol generating articles according to the disclosure find particular application in aerosol generating systems comprising an electrically heated aerosol generating device having an internal heater blade which is adapted to be inserted into the rod of aerosol generating substrate. Aerosol generating articles of this type are described in the prior art, for example, in EP 0822670.

As used herein, the term "aerosol generating device" refers to a device comprising a heater element that interacts with the aerosol generating substrate of the aerosol generating article to generate an aerosol.

As used herein, the term "aerosol generating system" refers to a combination of an aerosol generating device and an aerosol generating article.

As used herein, the term "aerosol generating article" refers to an article including an aerosol generating substrate that is heated to produce and deliver inhalable aerosol to a consumer.

The term "aerosol generating substrate element" is used herein to denote an aerosol generating substrate wrapped with a paper layer to form a portion of an aerosol generating article.

The term "aerosol generating substrate" refers to substance capable of generating or releasing an aerosol. The aerosol generating substrate may be a solid, paste, gel, slurry, liquid, or comprise any combination of solid, paste, gel, slurry, and liquid compounds. Preferably the aerosol generating substrate is a solid, or a gel composition. The aerosol generating substrate may preferably include nicotine.

The term "mouthpiece" is used herein to indicate the portion of the aerosol generating article that is designed to be contacted with the mouth of the consumer. The mouthpiece can be the portion of the aerosol generating article that may include a filter, or in some cases the mouthpiece can be defined by the extent of the tipping wrapper.

The terms "upstream" and "downstream" refer to relative positions of elements of the aerosol generating article described in relation to the direction of aerosol as it is drawn from an aerosol generating substrate and through the mouthpiece.

The aerosol generating substrate elements of the present invention includes an aerosol generating substrate wrapped with a thick dual wrapper. The aerosol generating substrate element includes an aerosol generating substrate and exactly two paper layers circumscribing the aerosol generating substrate.

The aerosol generating substrate element includes a cylindrical aerosol generating substrate element and a first paper wrapper and a second paper wrapper circumscribing the aerosol forming substrate. The first paper wrapper and the second paper wrapper have a combined thickness in a range from about 60 micrometres to about 200 micrometres. The first paper wrapper and the second paper wrapper do not extend beyond the aerosol generating substrate. The first paper wrapper does not overlap itself and a second paper wrapper does not overlap itself.

The aerosol generating substrate element includes a cylindrical aerosol generating substrate, a first paper wrapper, and a second paper wrapper. The first paper wrapper comprises opposing edges that abut each other to circumscribe the aerosol forming substrate and form a first seam line. The second paper wrapper comprises opposing edges that abut each other to circumscribe the first paper wrapper and form a second seam line. The first seam line is offset from the second seam line and the first paper wrapper and the second paper wrapper do not extend beyond the aerosol generating substrate.

Preferably the first seam line may be offset from the second seam line by at least about 5% of a circumference of the aerosol generating substrate. Preferably the first seam line may be offset from the second seam line by at least about 10% of a circumference of the aerosol generating substrate. Preferably the first seam line may be offset from the second seam line by at least about 15% of a circumference of the aerosol generating substrate.

The seam line may define a gap or void that is less than 10 micrometers in lateral dimension, or less than 5 micrometers in lateral dimension, or less than 2 micrometers in lateral dimension. Preferably the seam line does not define a gap. Preferably the opposing edges of the paper layer abut each other without an overlap. Preferably the opposing edges of the paper layer contact each other without an overlap.

Preferably the first seam line may be offset from the second seam line in a range from about 5% to about 20% of a circumference of the aerosol generating substrate. Preferably the first seam line may be offset from the second seam line in a range from about 5% to about 15% of a circumference of the aerosol generating substrate. Preferably the first seam line may be offset from the second seam line in a range from about 10% to about 20% of a circumference of the aerosol generating substrate.

The first seam line may be parallel with the second seam line. The first seam line may extend along an entire length of the aerosol generating substrate. The second seam line may extend along an entire length of the aerosol generating substrate. The first seam line may be parallel with the second seam line along the entire length of the aerosol generating substrate.

The aerosol generating substrate may be circumscribed by less than three paper layers at any point around a circumference of the aerosol generating substrate that do not extend beyond the aerosol generating substrate. The aerosol generating substrate may be circumscribed by less than three paper layers at any point along a length of the aerosol generating substrate that do not extend beyond the aerosol generating substrate. Preferably, the aerosol generating substrate may be circumscribed by less than three paper layers at any point around a circumference, and at any point along a length of the aerosol generating substrate that do not extend beyond the aerosol generating substrate.

A combined thickness of the first paper wrapper and the second paper wrapper is in a range from about 60 micrometres to about 200 micrometres. Preferably, the combined thickness of the first paper wrapper and the second paper wrapper is in a range from about 78 micrometres to about 160 micrometres. Preferably, the combined thickness of the first paper wrapper and the second paper wrapper is in a range from about 78 micrometres to about 140 micrometres. Preferably, the combined thickness of the first paper wrapper and the second paper wrapper is in a range from about 90 micrometres to about 140 micrometres. Preferably, the combined thickness of the first paper wrapper and the second paper wrapper is in a range from about 100 micrometres to about 140 micrometres. Preferably, the combined thickness of the first paper wrapper and the second paper wrapper is in a range from about 110 micrometres to about 140 micrometres. Preferably, the combined thickness of the first paper wrapper and the second paper wrapper is in a range from about 125 micrometres to about 140 micrometres. Preferably, the combined thickness of the first paper wrapper and the second paper wrapper is in a range from about 130 micrometres to about 140 micrometres.

The first paper wrapper may have a thickness in a range from about 25 micrometres to about 175 micrometres. The first paper wrapper may have a thickness in a range from about 50 micrometres to about 150 micrometres The first paper wrapper may have a thickness in a range from about 75 micrometres to about 125 micrometres The first paper wrapper may have a thickness in a range from about 100 micrometres to about 140 micrometres.

The second paper wrapper may have a thickness in a range from about 25 micrometres to about 175 micrometres. The second paper wrapper may have a thickness in a range from about 50 micrometres to about 150 micrometres The second paper wrapper may have a thickness in a range from about 75 micrometres to about 125 micrometres The second paper wrapper may have a thickness in a range from about 100 micrometres to about 140 micrometres.

The first paper wrapper and the second paper wrapper may have substantially equal thicknesses. The first paper wrapper may have a greater thickness than the second paper wrapper. The second paper wrapper may have a greater thickness than the first paper wrapper.

The first paper wrapper may be fixed to the second paper wrapper. The first paper wrapper may be adhered to the second paper wrapper. The first paper wrapper may be adhered to the second paper wrapper with an adhesive material. The adhesive material may have a thickness in a range from about 1 micrometre to about 30 micrometres, or from about 5 micrometres to about 25 micrometres, of from about 10 micrometres to about 25 micrometres. The adhesive material may be uniformly applied to the first paper wrapper and the second paper wrapper. The adhesive material may separate the first paper wrapper from the second paper wrapper The first paper wrapper and the second paper wrapper may have a uniform combined thickness that does not differ at any point around a circumference of the aerosol generating substrate element by more than about 30 micrometres. Preferably first paper wrapper and the second paper wrapper may have a uniform combined thickness that does not differ at any point around a circumference of the aerosol generating substrate element by more than about 20 micrometres. Preferably the first paper wrapper and the second paper wrapper may have a uniform combined thickness that does not differ at any point around a circumference of the aerosol generating substrate element by more than about 10 micrometres. Preferably the first paper wrapper and the second paper wrapper may have a uniform combined thickness that does not differ at any point around a circumference of the aerosol generating substrate element by more than about 5 micrometres The first paper wrapper may not extend beyond either of the ends of the aerosol generating substrate. The second paper wrapper may not extend beyond either of the ends of the aerosol generating substrate. The first paper wrapper and the second paper wrapper may not extend beyond either of the ends of the aerosol generating substrate.

The aerosol generating substrate element includes a cylindrical aerosol generating substrate, a first paper wrapper, and a second paper wrapper. The first paper wrapper comprises opposing edges that abut each other to circumscribe the aerosol forming substrate and form a first seam line wherein the first paper wrapper does not overlap or overlay onto itself. The second paper wrapper comprises opposing edges that abut each other to circumscribe the first paper wrapper and form a second seam line wherein the first paper wrapper does not overlap or overlay onto itself. The first seam line is offset from the second seam line and the first paper wrapper and the second paper wrapper do not extend beyond the aerosol generating substrate. Reducing an overlay or overlap of the paper wrapper onto themselves may help to prevent or minimize void spaces or air pockets defined between the paper layers.

The first and second paper wrappers may not extend beyond the ends of the aerosol generating substrate. Preferably, the first and second paper wrappers circumscribe an entire length of the aerosol generating substrate between the ends of the aerosol generating substrate. Preferably the first and second paper wrappers circumscribe an entire length of the aerosol generating substrate between the ends of the aerosol generating substrate and do not extend beyond one or both ends of the aerosol generating substrate.

The first and second paper wrappers may circumscribe the aerosol generating substrate to define the aerosol generating substrate element with a substantially cylindrical shape. The aerosol generating substrate may define a substantially cylindrical shape having a diameter in a range from about 6.8 mm to about 7.1 mm, or from about 6.8 mm to about 7.0 mm. The aerosol generating substrate element may define a substantially cylindrical shape having a diameter in a range from about 7.1 mm to about 7.3 mm, or from about 7.15 mm to about 7.25 mm.

The first paper wrapper and the second paper wrapper has a ratio of combined paper thickness to tobacco substrate diameter in a range from about 1:120 to about 1:40, or about 1:100 to about 1:50, or about 1:70 to about 1:50, or about 1:60 to about 1:50. Conventionally wrapped tobacco substrates may have a ratio of paper thickness to tobacco substrate diameter of about 1:300.

The first paper wrapper and the second paper wrapper has a ratio of combined paper thickness to tobacco substrate element diameter in a range from about 1:100 to about 1:40, or about 1:75 to about 1:50, or about 1:65 to about 1:50, or about 1:60 to about 1:50. Conventionally wrapped tobacco substrates may have a ratio of paper thickness to tobacco substrate element diameter of about 1:300.

The aerosol generating substrate element preferably includes an aerosol generating substrate having a diameter in a range from about 6.8 mm to about 7.1 mm and a first paper wrapper and the second paper wrapper combined paper thickness in a range from about 78 micrometers to 160 micrometers circumscribing the aerosol generating substrate and the first paper wrapper and the second paper wrapper do not overlap onto themselves. Preferably first paper wrapper and the second paper wrapper do not extend beyond the ends of the aerosol generating substrate. Preferably the first paper wrapper and the second paper wrapper circumscribe an entire length of the aerosol generating substrate.

An aerosol generating article may comprise an aerosol generating substrate and a mouthpiece. The mouthpiece may comprise a filter. A tipping wrapper may join the filter to the aerosol generating substrate. One or more intermediate sections may separate the aerosol generating substrate and a mouthpiece.

The tipping wrapper may be adhered to the first paper wrapper or the second paper wrapper. Preferably the tipping paper extends from the mouthpiece or filter segment to the aerosol generating substrate element. Preferably the tipping paper extends from the mouthpiece or filter segment to the aerosol generating substrate element and contacts and adheres to the second paper wrapper outer surface. The tipping paper preferably extends onto only a downstream portion of the aerosol generating substrate element. The tipping wrapper may overlay a downstream 25% or less of the aerosol generating substrate element.

An aerosol generating substrate may be a solid composition. This composition may include plant-based material. The aerosol generating substrate may include tobacco, and preferably the tobacco contains volatile tobacco flavour compounds, which are released from the aerosol generating substrate upon heating. The aerosol generating substrate may comprise homogenized tobacco material, aerosol former and a binder.

Nicotine may be present in the aerosol generating substrate in a range from about 0.5 to about 10% wt, nicotine, or about 0.5 to about 5% wt. nicotine. Preferably the aerosol generating substrate may include about 1 to about 3% wt, nicotine, or about 1.5 to about 2.5% wt. nicotine, or about 2% wt nicotine.

The aerosol generating substrate may comprise any suitable type or types of tobacco material or tobacco substitute, in any suitable form. The aerosol generating substrate may include flue-cured tobacco, Burley tobacco, Maryland tobacco, Oriental tobacco, specialty tobacco, homogenized or reconstituted tobacco, or any combination thereof. The aerosol generating substrate may be provided in the form of tobacco cut filler, tobacco lamina, processed tobacco materials, such as volume expanded or puffed tobacco, processed tobacco stems, such as cut-rolled or cut-puffed stems, homogenized tobacco, reconstituted tobacco, cast leaf tobacco, or blends thereof, and the like. The term "tobacco cut filler" is used herein to indicate tobacco material that is predominately formed from the lamina portion of the tobacco leaf. The terms "tobacco cut filler" is used herein to indicate both a single species of *Nicotiana* and two or more species of *Nicotiana* forming a tobacco cut filler blend.

As used herein, the term "homogenised tobacco" denotes a material formed by agglomerating particulate tobacco. Homogenized tobacco may include reconstituted tobacco or cast leaf tobacco, or a mixture of both. The term "reconstituted tobacco" refers to paper-like material that can be made from tobacco by-products, such as tobacco fines, tobacco dusts, tobacco stems, or a mixture of the foregoing. Reconstituted tobacco can be made by extracting the soluble chemicals in the tobacco by-products, processing the leftover tobacco fibers into a sheet, and then reapplying the extracted materials in concentrated form onto the sheet. The term "cast leaf tobacco" is used herein to refer to a product resulting from a process well known in the art, which is based on casting a slurry comprising ground tobacco particles and a binder (for example, guar) onto a supportive surface, such as a belt conveyor, drying the slurry and removing the dried sheet from the supportive surface. Exemplary methods for producing these types of aerosol generating substrates are described in U.S. Pat. Nos. 5,724,998; 5,584,306; 4,341,228; 5,584,306 and 6,216,706. The homogenised tobacco may be formed into a sheet which is crimped, convoluted, folded, or otherwise compressed, before being wrapped to form a rod. For example, sheets of homogenised tobacco material for use in the invention may be crimped using a crimping unit of the type described in CH-A-691156, which comprises a pair of rotatable crimping rollers. However, it will be appreciated that sheets of homogenised tobacco material for use in the invention may be textured using other suitable machinery and processes that deform or perforate the sheets of homogenised tobacco material.

The aerosol generating substrate used in aerosol generating articles generally includes a higher level of aerosol former(s) than combusted smoking articles, such as cigarettes. Humectants can also be referred to as an "aerosol former". An aerosol former is used to describe any suitable known compound or mixture of compounds that, in use, facilitates formation of an aerosol and that is substantially resistant to thermal degradation at the operating temperature of the aerosol generating substrate. Suitable aerosol-formers are known in the art and include, but are not limited to: polyhydric alcohols, such as propylene glycol, triethylene glycol, 1,3-butanediol and glycerine; esters of polyhydric alcohols, such as glycerine mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as propylene glycol, triethylene glycol, 1,3-butanediol and, most preferred, glycerine or glycerine. The aerosol generating substrate may comprise a single aerosol former. Alternatively, the aerosol generating substrate may comprise a combination of two or more aerosol formers.

The aerosol generating substrate may have a high level of aerosol former. As used herein, a high level of aerosol former means aerosol former content that is greater than about 10% or preferably greater than about 15% or more preferably greater than about 20%, by weight. The aerosol generating substrate can also have an aerosol former content of between about 10% and about 30%, from about 15% and about 30%, or from about 20% and about 30%, by weight. The aerosol generating substrate can also have a glycerine content of between about 10% and about 30%, from about 15% and about 30%, or from about 20% and about 30%, by weight.

The aerosol generating substrate may comprise at least about 1%, or at least about 2%, or at least about 5%, or at least about 7%, or at least about 10%, or at least about 12%, or at least about 15%, or at least about 18% aerosol former, by weight. The aerosol generating substrate may comprise aerosol former in a range from about 1 to about 20%, or about 5 to about 20%, or about 10 to about 20%, by weight.

The aerosol generating substrate may comprise at least about 1%, or at least about 2%, or at least about 5%, or at least about 7%, or at least about 10%, or at least about 12%, or at least about 15%, or at least about 18% glycerine, by weight. The aerosol generating substrate may comprise glycerine in a range from about 1 to about 20%, or about 5 to about 20%, or about 10 to about 20%, by weight.

Preferably, the aerosol generating article may be generally cylindrical. This enables a smooth flow of the aerosol. The aerosol generating article may have an outer diameter, for example, between 7.1 millimetres and 7.3 millimetres, or from 7.15 millimetres and 7.25 millimetres. The aerosol generating article may have a length, for example, between 10 millimetres and 60 millimetres, between 15 millimetres to 50 millimetres, or between 20 millimetres and 45 millimetres.

The aerosol generating substrate may include a flavourant. Botanical materials provide flavourant that may impart a flavour to the taste of the aerosol generated by the aerosol generating article. A flavourant is any natural or artificial compound that affects the organoleptic quality of the aerosol. Non-limiting examples of sources of flavourants include mints such as peppermint and spearmint, coffee, tea, cinnamon, clove, cocoa, vanilla, eucalyptus, geranium, agave, and juniper; and combinations thereof.

The aerosol generating substrate may include an essential oil. Essential oils may provide flavourant that may impart a flavour to the taste of the aerosol generated by the aerosol generating article. Suitable essential oils include, but are not limited to, eugenol, peppermint oil and spearmint oil. A preferred essential oil is eugenol. Essential oil may be present in the aerosol generating substrate in an amount of at least about 0.1% by weight, or at least about 0.5% by weight, or at least about 1% by weight. Essential oil may be present in the aerosol generating substrate in a range from about 0.1% by weight to about 10% by weight, or from about 0.1% by weight to about 5% by weight, or from about 0.5% by weight to about 2%.

The aerosol generating substrate may include homogenized tobacco material. The homogenized tobacco material may include tobacco material, from about 1 percent to about 5 percent of a binder, and from about 5 percent to about 30 percent of an aerosol-former, on a dry weight basis. The aerosol generating substrate may include homogenized tobacco material. The homogenized tobacco material may include tobacco material, from about 1 percent to about 5 percent of a binder, and from about 10 percent to about 30 percent glycerine, on a dry weight basis.

Sheets of homogenized tobacco for use in the aerosol-generating article of the present invention may be made by methods known in the art, for example the methods disclosed in International patent application WO-A-2012/164009 A2. In a preferred embodiment, sheets of homogenized tobacco material for use in the aerosol-generating article are formed from a slurry comprising particulate tobacco, guar gum, cellulose fibres and glycerine by a casting process.

The aerosol generating substrate may include a gathered sheet of homogenized tobacco material that is preferably crimped. As used herein, the term "crimped" denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article.

An aerosol generating system may comprise: an aerosol generating article comprising the aerosol generating substrate element, as described herein, joined to a filter element, and an aerosol generating device comprising a heating element configured to heat the aerosol generating substrate element.

The heating element may be integral with an aerosol generating device and a consumable aerosol generating article may be releasably received within the aerosol generating device.

The heating element may be a combustible heat source, a chemical heat source, an electrical heat source, a heat sink or any combination thereof. Preferably, the heat source is an electrical heat source, preferably shaped in the form of a blade that can be inserted into the aerosol generating substrate. Alternatively, the heat source may be configured to surround the aerosol generating substrate, and as such may be in the form of a hollow cylinder, or any other such suitable form.

Preferably the heating element is configured to heat the aerosol generating substrate directly without transmitting heat to the aerosol generating substrate through the first or second paper wrappers.

The aerosol generating substrate may include an induction heating element or susceptor or a plurality of induction heating elements or susceptors. Induction heating elements or susceptors heat up in the presence of an alternating or fluctuating electromagnetic field. When heating is by induction heating, a fluctuating electromagnetic field is transmitted through the aerosol generating article to the induction heating element or susceptor such that the susceptor or inducting heating element changes the fluctuating field into thermal energy thus heating the aerosol generating substrate.

The induction heating element or susceptor may be formed from any material that can be inductively heated to a temperature sufficient to generate an aerosol from the aerosol generating substrate. The induction heating element or susceptor may comprises a metal or carbon. A preferred induction heating element or susceptor may comprise a ferromagnetic material, for example ferritic iron, or a ferromagnetic steel or stainless steel. The induction heating element or susceptor may comprise aluminium. Induction heating element or susceptors may be formed from 400 series stainless steels, for example grade 410, or grade 420, or grade 430 stainless 20 steel. Different materials will dissipate different amounts of energy when positioned within electromagnetic fields having similar values of frequency and field strength. Preferably, the induction heating element or susceptors are heated to a temperature in excess of 250 degrees Celsius. However, preferably the induction heating element or susceptors are heated less than 350 degrees Celsius to prevent burning of material in contact with the susceptor.

The aerosol generating substrate may comprise a metallic induction heating element. The metallic induction heating element may comprise plurality of metallic induction heating elements. The metallic induction heating element may comprise a metallic induction heating ring element.

This first paper wrapper may exhibit a range of permeability including not being permeable. Permeability of cigarette paper is determined by utilizing the International Standard test method ISO 2965:2009 and the result is presented as cubic centimetres per minute per square centimetre and referred to as "CORESTA units". The permeability of the first paper wrapper described herein may be in a range from about 1 to about 10 CORESTA units, about 5 to about 20 CORESTA units, or about 1 to about 5 CORESTA units.

The first paper wrapper layer may be formed of any cellulosic material such as paper, wood, textile, natural as well as artificial fibers.

This second paper wrapper may exhibit a range of permeability including not being permeable. Permeability of cigarette paper is determined by utilizing the International Standard test method ISO 2965:2009 and the result is presented as cubic centimetres per minute per square centimetre and referred to as "CORESTA units". The permeability of the second paper wrapper described herein may be in a range from about 1 to about 10 CORESTA units, about 5 to about 20 CORESTA units, or about 1 to about 5 CORESTA units.

The second paper wrapper layer may be formed of any cellulosic material such as paper, wood, textile, natural as well as artificial fibers.

The first or second paper layer may comprise a laminate of a paper layer and a metal layer. The first paper layer may comprise a laminate of a paper layer and a metal layer. The second paper layer may comprise a laminate of a paper layer and a metal layer. The first and second paper layer may comprise a laminate of a paper layer and a metal layer.

The metal layer may be an aluminium layer. The first or second paper layer may comprise a laminate of a paper layer and an aluminium layer. The laminate of a paper layer and an aluminium layer may have a uniform thickness in a range from about 78 micrometers to about 160 micrometers, or from about 78 micrometers to about 140 micrometers, or from about 100 micrometers to about 140 micrometers, or from about 125 micrometers to about 140 micrometers. The laminate of a paper layer and a metal layer may not extend beyond ends of the aerosol generating substrate.

The resistance to draw (RTD) of the aerosol-generating article after insertion into the aerosol generating device is preferably between about 80 mm WG and about 140 mm WG, more preferably between about 100 mm WG and about 120 mm WG.

As used herein, resistance to draw is expressed with the units of pressure 'mm WG' or 'mm of water gauge' and is measured in accordance with ISO 6565:2002. The resistance to draw (RTD) of the rod of aerosol-generating substrate is preferably between about 50 mm WG and about 80 mm WG. Preferably, the RTD of the rod of aerosol-generating substrate is between about 5 mm WG and about 8 mm WG per millimetre length of the rod.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass examples having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to examples of the invention that may afford certain benefits under certain circumstances. However, other examples may also be preferred under the same or other circumstances. Furthermore, the recitation of one or more preferred examples does not imply that other examples are not useful and is not intended to exclude other examples from the scope of the disclosure, including the claims.

Figure 1:
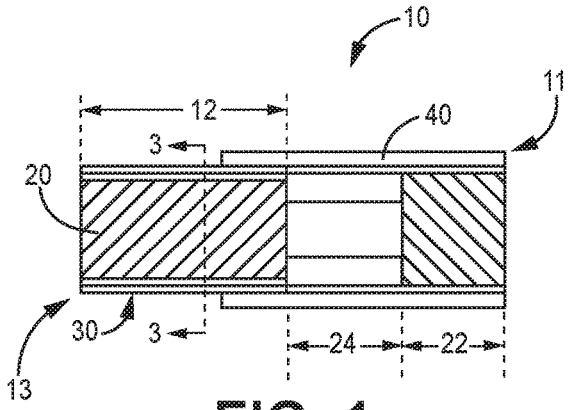
FIG. 1 is a schematic cross-sectional diagram of an aerosol generating article.

The aerosol generating articles depicted in FIGS. 1-6 illustrate one or more examples of aerosol generating articles, components of aerosol generating articles, or aerosol generating systems described above. The schematic drawings are not necessarily to scale and are presented for purposes of illustration and not limitation. The drawings depict one or more aspects described in this disclosure. However, it will be understood that other aspects not depicted in the drawings fall within the scope and spirit of this disclosure.

The aerosol generating article 10, of FIG. 1, illustrates an aerosol generating substrate element 12 including an aerosol generating substrate 20 wrapped with dual paper wrapper 30. An intermediate section 24 separates a filter element 22 from the aerosol generating substrate element 12. The aerosol generating substrate element 12, intermediate section 24, and a filter element 22 are aligned from a distal end 13 to a proximal end 11 in serial order and form a cylinder. A tipping paper or tipping wrapper 40 circumscribes the aerosol generating article 10 to join the aerosol generating substrate element 12 to the intermediate section 24, and a filter element 22.

The intermediate section 24 may comprise on or more of, a hollow cellulose acetate tube or a polylactic acid filter segment. The filter element 22 may define a mouthpiece segment and be formed of cellulose acetate material. The aerosol generating substrate element 12, the intermediate section 24, and a filter element 22 may be individually wrapped with a paper layer and then joined to each other with the tipping paper or tipping wrapper 40. In particular, the aerosol generating substrate element 12 is wrapped with the dual paper wrapper 30, as described herein.

The aerosol generating article 10 has a mouth end or proximal end 11 and an upstream, distal end 13 located at the opposite end of the article to the mouth end 11. The aerosol generating article 10 shown in FIG. 1 is particularly suitable for use with an electrically operated aerosol generating device comprising a heater for heating the aerosol generating substrate element 12.

Figure 2:
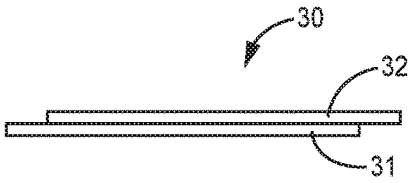
FIG. 2 is a schematic cross-sectional diagram of the first paper wrapper and second paper wrapper prior to being wrapped about the aerosol generating substrate.
Figure 3:
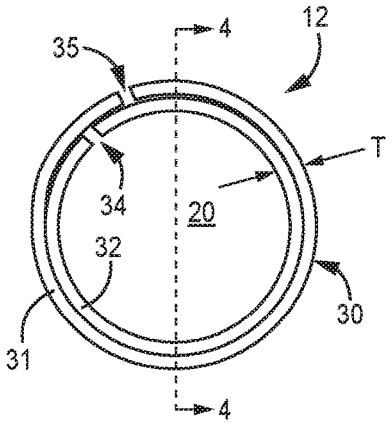
FIG. 3 is a schematic cross-sectional diagram of the aerosol generating substrate element along line 3-3 in FIG. 1.
Figure 4:
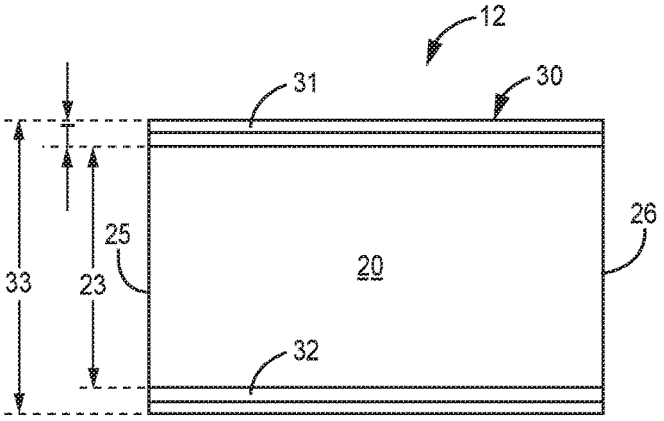
FIG. 4 is a schematic cross-sectional diagram of the aerosol generating substrate element along line 4-4 in FIG. 3.

FIG. 2 is a schematic cross-sectional diagram of the first paper wrapper 31 and second paper wrapper 32 or dual paper wrapper 30, prior to being wrapped about the aerosol generating substrate 20. FIG. 3 is a schematic cross-sectional diagram of the aerosol generating substrate element 12 along line 3-3 in FIG. 1. FIG. 4 is a schematic cross-sectional diagram of the aerosol generating substrate element 12 along line 4-4 in FIG. 3.

A first paper wrapper 31 comprises opposing edges that abut each other to circumscribe the aerosol forming substrate 20 and form a first seam line 35. A second paper wrapper 32 comprises opposing edges that abut each other to circumscribe the first paper wrapper 31 and form a second seam line 34. The first seam line 35 is offset from the second seam line 34 and the first paper wrapper 31 and the second paper wrapper 32 do not extend beyond the aerosol generating substrate 20 or beyond the ends 25, 26 of the aerosol generating substrate 20.

The dual paper wrapper 30 circumscribes the aerosol generating substrate 20 to define the aerosol generating substrate element 12 with a substantially cylindrical shape. The aerosol generating substrate 20 defines a substantially cylindrical shape having a diameter 23 in a range from about 6.8 mm to about 7.1 mm, or from about 6.8 mm to about 7.0 mm. The aerosol generating substrate element 12 defines a substantially cylindrical shape having a diameter 33 in a range from about 7.1 mm to about 7.3 mm, or from about 7.15 mm to about 7.25 mm.

The dual paper wrapper 30 has a thickness T in a range from about 60 micrometers to about 200 micrometers. The dual paper wrapper 30 may preferably have a thickness in a range from about 78 micrometers to about 160 micrometers, or from about 78 micrometers to about 140 micrometers, or from about 90 micrometers to about 140 micrometers, or from about 100 micrometers to about 140 micrometers, or from about 110 micrometers to about 140 micrometers, or from about 125 micrometers to about 140 micrometers, or from about 130 micrometers to about 140 micrometers.

The dual paper wrapper 30 has a ratio of paper thickness T to tobacco substrate diameter 23 in a range from about 1:120 to about 1:40, or about 1:100 to about 1:50, or about 1:70 to about 1:50, or about 1:60 to about 1:50.

The dual paper wrapper 30 circumscribes the entire circumference of the aerosol generating substrate 20 without overlap of the first paper wrapper 31 onto itself and without overlay of the second paper wrapper 32 onto itself. The dual paper wrapper 30 defines less than three paper layers at any point about the circumference of the aerosol generating substrate element 12.

Figure 5:
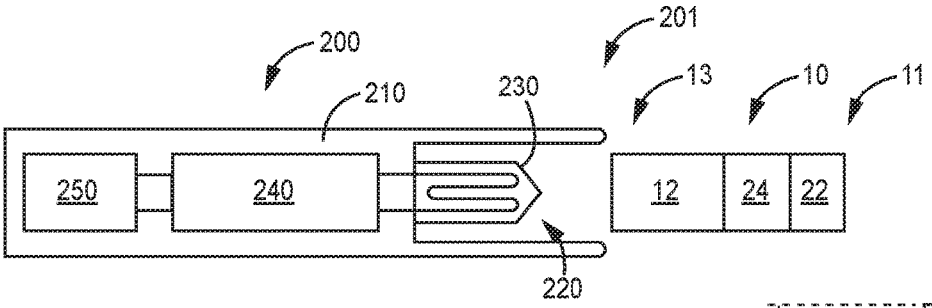
FIG. 5 is a schematic cross-sectional diagram of an aerosol generating system.
Figure 6:
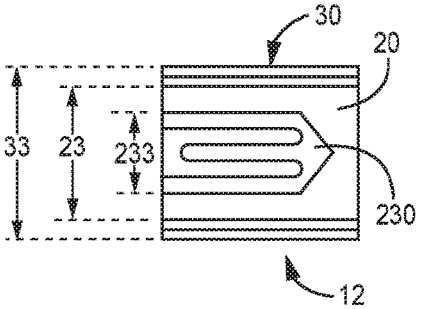
FIG. 6 is a schematic cross-sectional diagram a heating blade inserted into the aerosol generating substrate element.

FIG. 5 is a schematic cross-sectional diagram of an aerosol generating system 201. FIG. 6 is a schematic cross-sectional diagram a heating blade 230 inserted into the aerosol generating substrate element 12. The aerosol generating article 10 may be used with the aerosol generating device 200 as illustrated in FIG. 5 and FIG. 6.

The aerosol generating device 200 includes a housing 210 defining the receptacle 220, which is configured to receive the aerosol generating article 10. The aerosol generating device 200 also includes a heating blade element 230 configured to pierce the aerosol generating substrate element 12 of the aerosol generating article 10. The heating blade element 230 may comprise an electrically resistive heating component. In addition, the device 200 includes a power supply 240 and control electronics 250 that cooperate to control heating of heating blade element 230.

The aerosol generating article 10 illustrates an aerosol-generating substrate element 12, an intermediate section 24, and a filter element 22 aligned from a distal end 13 to a proximal end 11 in serial order and form a cylinder. The distal end 13 of the aerosol generating article 10. The aerosol generating substrate 12 has a length of about 12 millimetres. The aerosol generating substrate 12 is cylindrical in shape and has a substantially circular cross-section. The aerosol generating substrate 12 may comprise a gathered sheet of homogenised tobacco material. The sheet of homogenised tobacco material may comprise about 10 percent by weight on a dry basis of glycerine. The intermediate section 24 may be a hollow cellulose acetate tube having a length of about 8 millimetres and a thickness of 1 millimetre. The mouthpiece segment or filter element 22 may comprises a plug of cellulose acetate tow of 8 denier per filament and has a length of about 7 millimetres.

FIG. 6 illustrates the heating blade element 230 disposed within the aerosol generating substrate 12. The heating blade element 230 may heat the aerosol generating substrate 12, 20 of the aerosol generating article 10. Heating of the aerosol generating substrate 12 causes the aerosol generating substrate 12 to generate an aerosol containing the nicotine which can transfer out of the aerosol generating article 10 at the proximal end 11.

The heating blade element 230 may have a width 233 of about 5 mm. The aerosol generating substrate 20 defines a substantially cylindrical shape having a diameter 23 in a range from about 6.8 mm to about 7.1 mm. The aerosol generating substrate element 12 defines a substantially cylindrical shape having a diameter 33 in a range from about 7.1 mm to about 7.3 mm. The heating blade element 230 may lie within about 1 mm from the dual paper wrapper 30.

In some examples the heating mechanism may be by induction where the heating element emits radio-magnetic radiation which is absorbed by one or more metallic induction heating elements when the aerosol generating article 10 is positioned in the receptacle 220 of the aerosol generating device 200.

Once the aerosol generating article 10 is releasably received in the aerosol generating device 200 and on the heating blade element 230, the aerosol generating device 200 is actuated to heat the aerosol generating substrate 12 to a temperature of approximately 375 degrees Celsius. As a user draws on the mouth end 11 of the aerosol generating article 10, the volatile compounds evolved from the aerosol generating substrate 12 are drawn downstream through the aerosol generating article 10 and condense to form an aerosol that is drawn through the mouthpiece 11 of the aerosol generating article 10 into the user's mouth.

The exemplary examples described above are not limiting. Other examples consistent with the exemplary examples described above will be apparent to those skilled in the art.

The invention claimed is:

1. An aerosol generating substrate element comprising:

a cylindrical aerosol generating substrate comprising from about 10% to about 30% glycerine by weight;

a first paper wrapper comprises opposing edges that abut each other to circumscribe the aerosol generating substrate and form a first seam line;

a second paper wrapper comprises opposing edges that abut each other to circumscribe the first paper wrapper and form a second seam line; and the first seam line is offset from the second seam line and the first paper wrapper and the second paper wrapper do not extend beyond the aerosol generating substrate.

2. The aerosol generating substrate element according to claim 1, wherein the first seam line is offset from the second seam line by at least about 5% of a circumference of the aerosol generating substrate.

3. The aerosol generating substrate element according to claim 1, wherein the aerosol generating substrate is circumscribed by less than three paper layers at any point around a circumference of the aerosol generating substrate that do not extend beyond the aerosol generating substrate.

4. The aerosol generating substrate element according to claim 1, wherein the first paper wrapper and the second paper wrapper have a combined thickness in a range from about 60 micrometres to about 200 micrometres.

5. The aerosol generating substrate element according to claim 1, wherein the first paper wrapper and the second paper wrapper have a uniform combined thickness that does not differ at any point around a circumference of the aerosol generating substrate element by more than about 30 micrometres.

6. The aerosol generating substrate element according to claim 1, wherein the aerosol generating substrate has a diameter in a range from about 6.8 mm to about 7.1 mm.

7. The aerosol generating substrate element according to claim 1, wherein the first paper wrapper and the second paper wrapper have a ratio of combined paper thickness to tobacco substrate diameter in a range from about 1:120 to about 1:40.

8. The aerosol generating substrate element according to claim 1, wherein the aerosol generating substrate comprises homogenized tobacco material.

9. The aerosol generating substrate element according to claim 8, wherein the homogenized tobacco material comprises tobacco material, from about 1 percent to about 5 percent of a binder, and from about 10 percent to about 30 percent glycerine, in dry weight basis.

10. The aerosol generating substrate element according to claim 1, wherein the aerosol generating substrate comprises a metallic induction heating element.

11. The aerosol generating substrate element according to claim 1, wherein the aerosol generating substrate comprises a plurality of metallic induction heating elements.

12. An aerosol generating system comprising:

an aerosol generating article comprising the aerosol generating substrate element according to claim 1 joined to a filter element; and an aerosol generating device comprising a heating element configured to heat the aerosol generating substrate element.

13. The aerosol generating system according to claim 12, wherein the heating element is a resistive heating blade element configured to be inserted into the aerosol generating substrate element.

14. The aerosol generating system according to claim 12, wherein the heating element is in inductive heating element configured to inductively heat metallic induction heating elements embedded within the aerosol generating substrate element.

15. The aerosol generating substrate element according to claim 1, wherein the first paper wrapper and the second paper wrapper have a combined thickness in a range from about 78 micrometres to about 160 micrometres.

16. The aerosol generating substrate element according to claim 15, wherein the first paper wrapper and the second paper wrapper have a uniform combined thickness that does not differ at any point around a circumference of the aerosol generating substrate element by more than about 20 micrometres.

17. The aerosol generating substrate element according to claim 1, wherein the first paper wrapper and the second paper wrapper have a combined thickness in a range from about 100 micrometres to about 140 micrometres, and the first paper wrapper and the second paper wrapper have a uniform combined thickness that does not differ at any point around a circumference of the aerosol generating substrate element by more than about 10 micrometres.

18. The aerosol generating substrate element according to claim 16, wherein the first seam line is offset from the second seam line by at least about 10% of a circumference of the aerosol generating substrate.

19. The aerosol generating substrate element according to claim 16, wherein the first paper wrapper and the second paper wrapper have a ratio of combined paper thickness to tobacco substrate diameter in a range from about 1:100 to about 1:50.

20. The aerosol generating substrate element according to claim 19, wherein the aerosol generating substrate comprises a plurality of metallic induction heating elements.

* * * * *